US011421406B2

(12) United States Patent
Cannon

(10) Patent No.: US 11,421,406 B2
(45) Date of Patent: Aug. 23, 2022

(54) TIMED TOUCHLESS FAUCET ASSEMBLY

(71) Applicant: Wanda Cannon, Atlanta, GA (US)

(72) Inventor: Wanda Cannon, Atlanta, GA (US)

( * ) Notice: Subject to any disclaimer, the term of this patent is extended or adjusted under 35 U.S.C. 154(b) by 212 days.

(21) Appl. No.: 16/889,972

(22) Filed: Jun. 2, 2020

(65) Prior Publication Data

US 2021/0372103 A1 Dec. 2, 2021

(51) Int. Cl.
*E03C 1/05* (2006.01)
*E03C 1/04* (2006.01)
*G08B 21/24* (2006.01)

(52) U.S. Cl.
CPC ..... *E03C 1/057* (2013.01); *E03C 1/0404* (2013.01); *G08B 21/245* (2013.01)

(58) Field of Classification Search
CPC ..... E03C 1/055; E03C 1/057; G08B 21/245
See application file for complete search history.

(56) References Cited

U.S. PATENT DOCUMENTS 5,979,500 A * 11/1999 Jahrling ..... E03C 1/057 137/624.12
10,323,969 B2 * 6/2019 Geller ..... G01F 15/063
10,550,555 B2 * 2/2020 Chen ..... G05D 7/0635
2020/0199856 A1 * 6/2020 Davis ..... F16K 19/006

* cited by examiner

*Primary Examiner* — Janie M Loeppke

(57) ABSTRACT

A timed touchless faucet assembly for indicating to a user a time remaining for a flow of water includes a spout that is coupled to a surface proximate to a basin. An upper end of the spout is positioned over the basin. A sensor, which is proximity type, and a barometer are coupled to the spout. A controller, which comprises a power module, is operationally coupled to the sensor, the barometer, the spout, and a water source. The controller is positioned to receive a signal from the sensor when a hand of the user is positioned between the upper end of the spout and the basin. The controller is configured to selectively fluidically couple the spout to the water source concurrently with coupling the barometer to the power module. The barometer provides an indication to the user of the time remaining for the flow of water through the spout.

16 Claims, 6 Drawing Sheets

TIMED TOUCHLESS FAUCET ASSEMBLY

(b) CROSS-REFERENCE TO RELATED APPLICATIONS

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

(2) Description of Related Art Including Information Disclosed Under 37 CFR 1.97 and 1.98

The disclosure and prior art relates to faucet assemblies and more particularly pertains to a new faucet assembly for indicating to a user a time remaining for a flow of water.

(h) BRIEF SUMMARY OF THE INVENTION

An embodiment of the disclosure meets the needs presented above by generally comprising a spout that is coupled to a surface proximate to a basin. An upper end of the spout is positioned over the basin. A sensor, which is proximity type, and a barometer are coupled to the spout. A controller, which comprises a power module, is operationally coupled to the sensor, the barometer, the spout, and a water source. The controller is positioned to receive a signal from the sensor when a hand of a user is positioned between the upper end of the spout and the basin. The controller is configured to selectively fluidically couple the spout to the water source concurrently with coupling the barometer to the power module. The barometer provides an indication to the user of a time remaining for the a of water through the spout.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
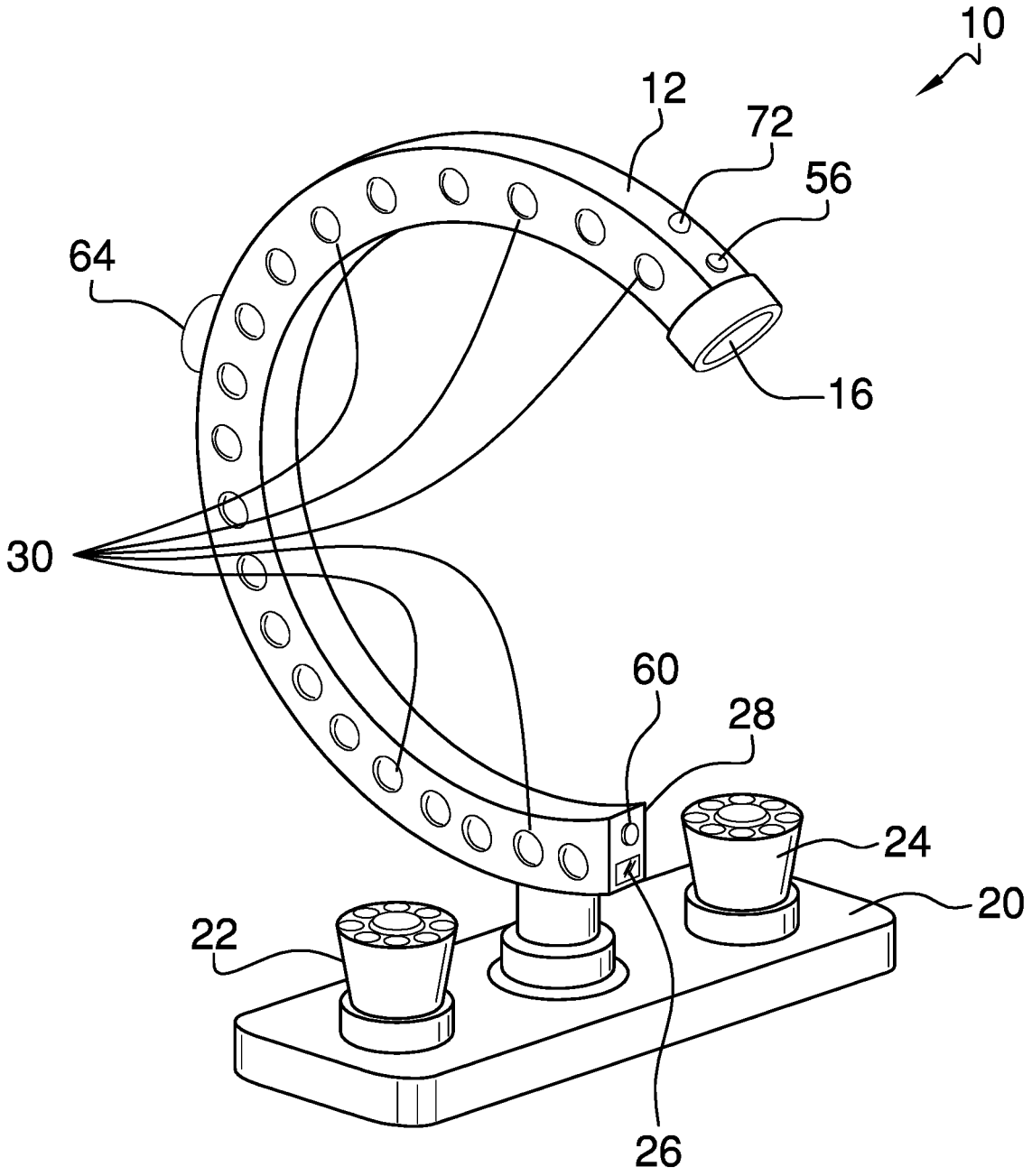
FIG. 1 is an isometric perspective view of a timed touchless faucet assembly according to an embodiment of the disclosure.
Figure 2:
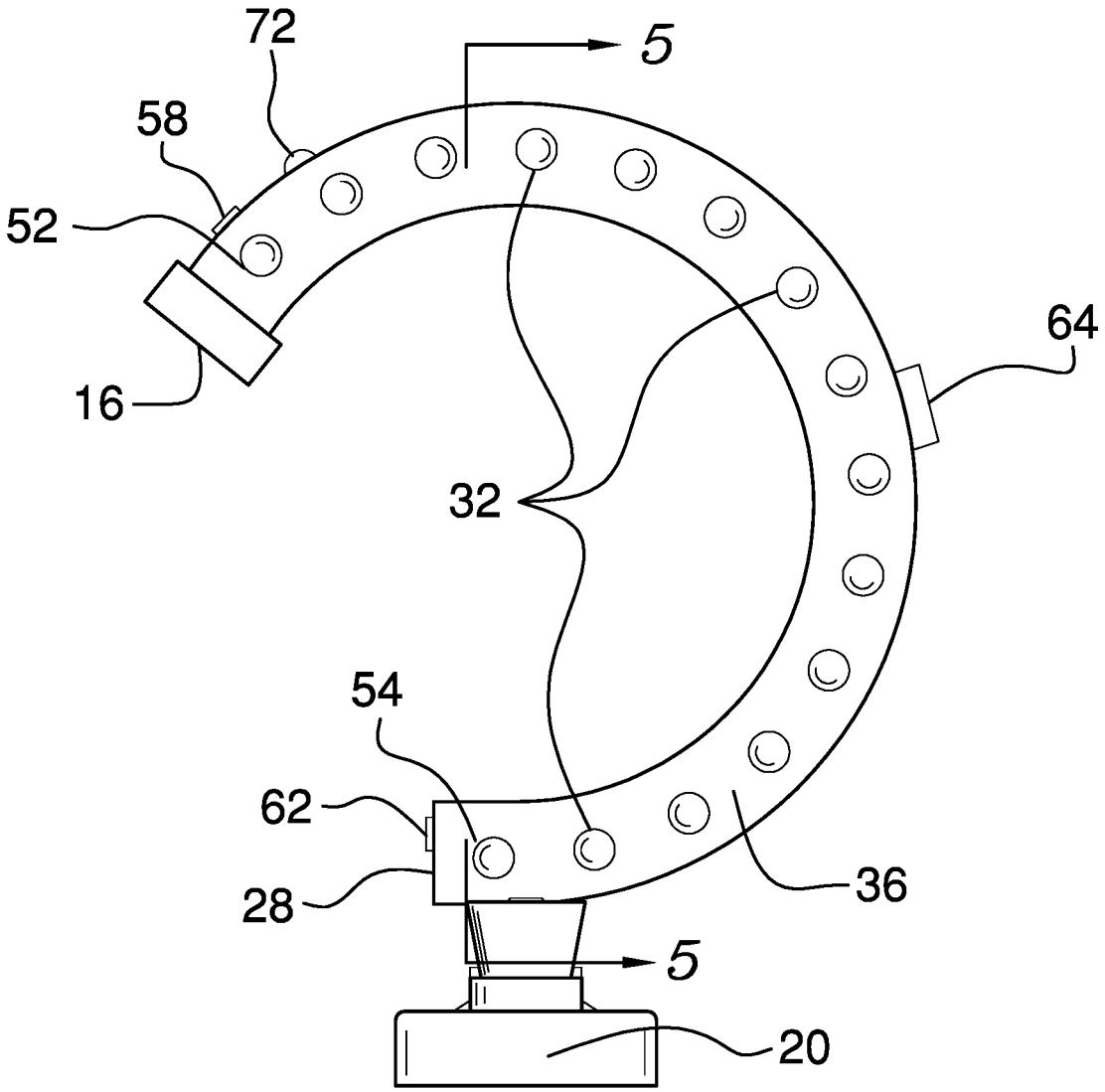
FIG. 2 is a side view of an embodiment of the disclosure.

With reference now to the drawings, and in particular to FIGS. 1 through 6 thereof, a new faucet assembly embodying the principles and concepts of an embodiment of the disclosure and generally designated by the reference numeral 10 will be described.

As best illustrated in FIGS. 1 through 6, the timed touchless faucet assembly 10 generally comprises a spout 12 and a controller 14. The spout 12 is coupled to a surface proximate to a basin. An upper end 16 of the spout 12 is positioned over the basin. The spout 12 is substantially C-shaped. The spout 12 has a cross-sectional profile 18 that is substantially rectangularly shaped.

A base 20 is coupled to and positioned between the spout 12 and the surface proximate to the basin. A hot-water knob 22 and a cold-water knob 24 are rotationally coupled to the base 20.

A sensor 26 is coupled to the spout 12. The sensor 26 is proximity type. The sensor 26 is configured to detect a hand of a user that is positioned between the upper end 16 of the spout 12 and the basin. The sensor 26 is positioned on a lower end 28 of the spout 12, as shown in FIG. 1.

Figure 5:
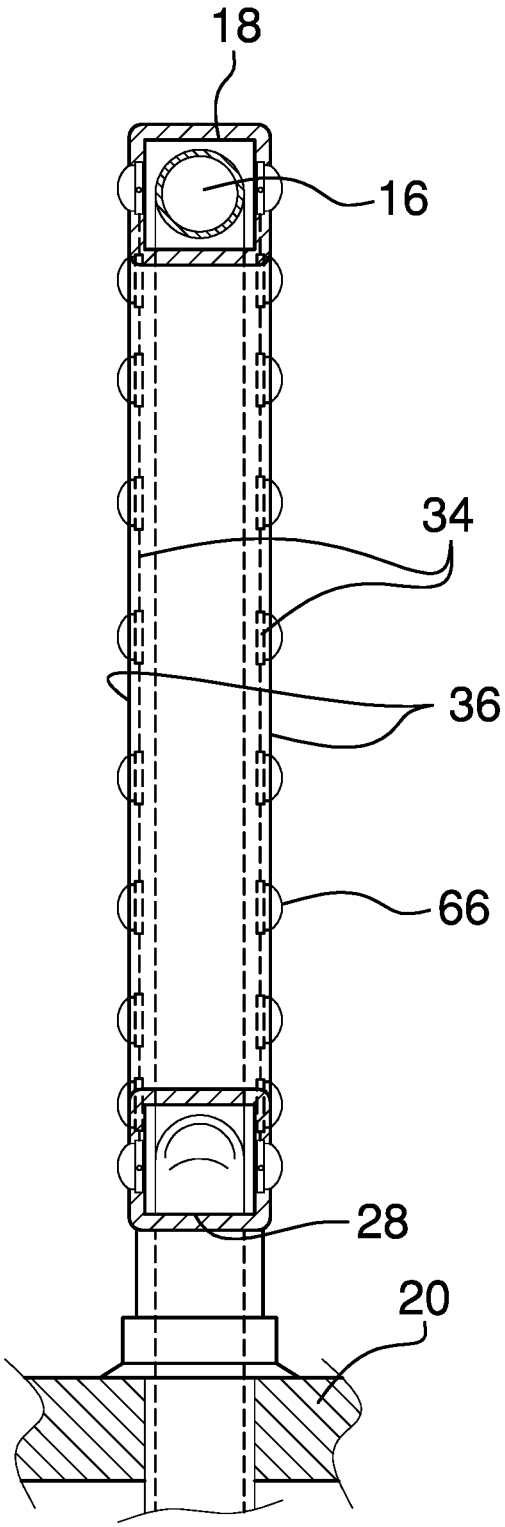
FIG. 5 is a cross-sectional view of an embodiment of the disclosure.
Figure 6:
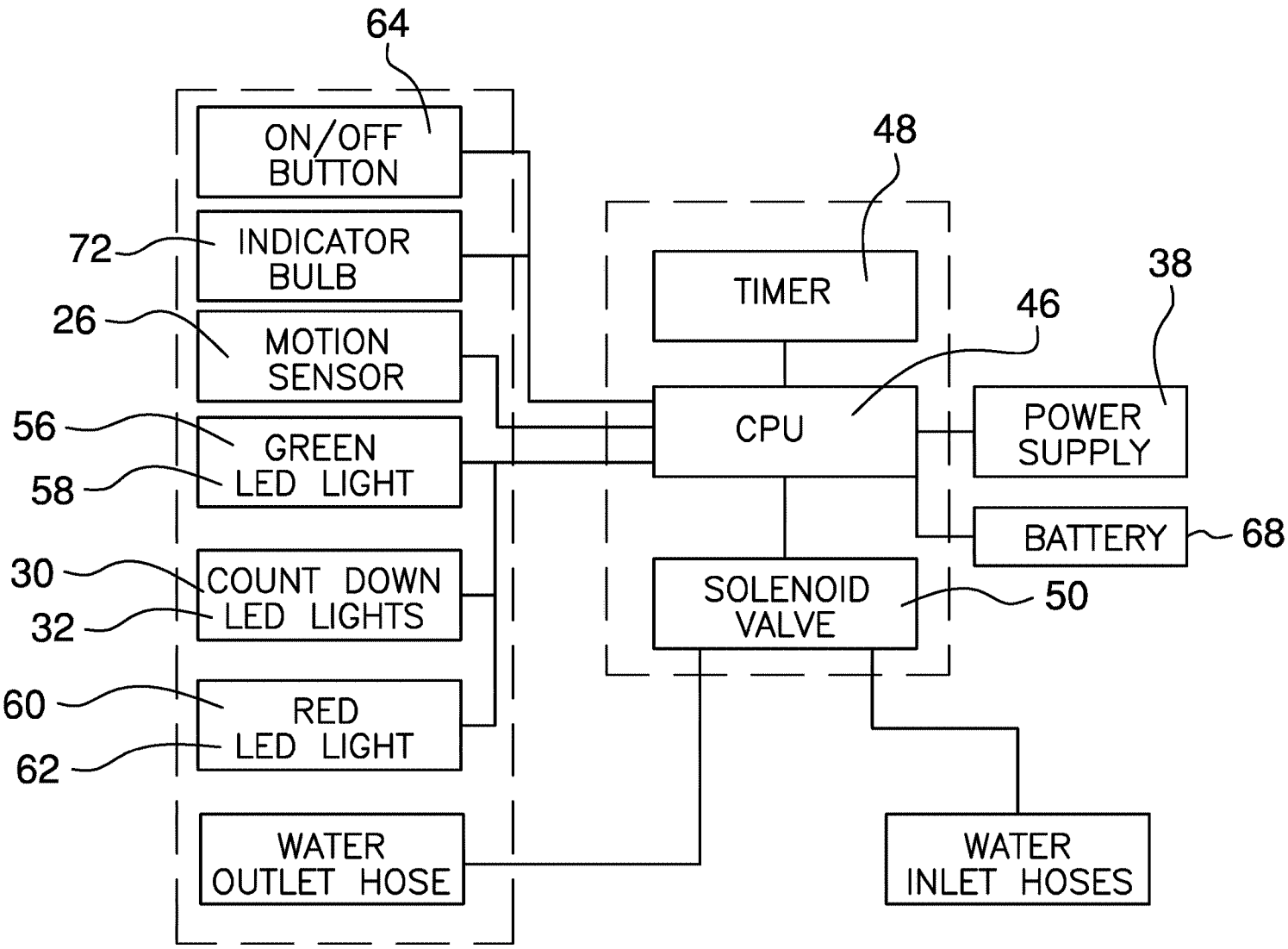
FIG. 6 is a block diagram of an embodiment of the disclosure.

A barometer 30 is coupled to the spout 12. The barometer 30 comprises a plurality of lights 32 that is coupled to the spout 12. Each light comprises a light emitting diode 66. The lights 32 are positioned in a plurality of rows 34. Each row 34 extends from proximate to the upper end 16 to proximate to the lower end 28 of the spout 12. The plurality of rows 34 comprises two rows 34 that are positioned singly on opposing sides 36 of the spout 12, as shown in FIG. 5.

The controller 14 comprises a power module 38. The controller 14 is operationally coupled to the sensor 26, the barometer 30, the spout 12, and a water source. The controller 14 is positioned to receive a signal from the sensor 26 when the hand is positioned between the upper end 16 of the spout 12 and the basin. The controller 14 is configured to selectively and fluidically couple the spout 12 to the water source. Concurrently, the controller 14 is positioned to operationally couple the barometer 30 to the power module 38 so that the barometer 30 provides an indication to the user of a time remaining for a flow of water through the spout 12.

Figure 4:
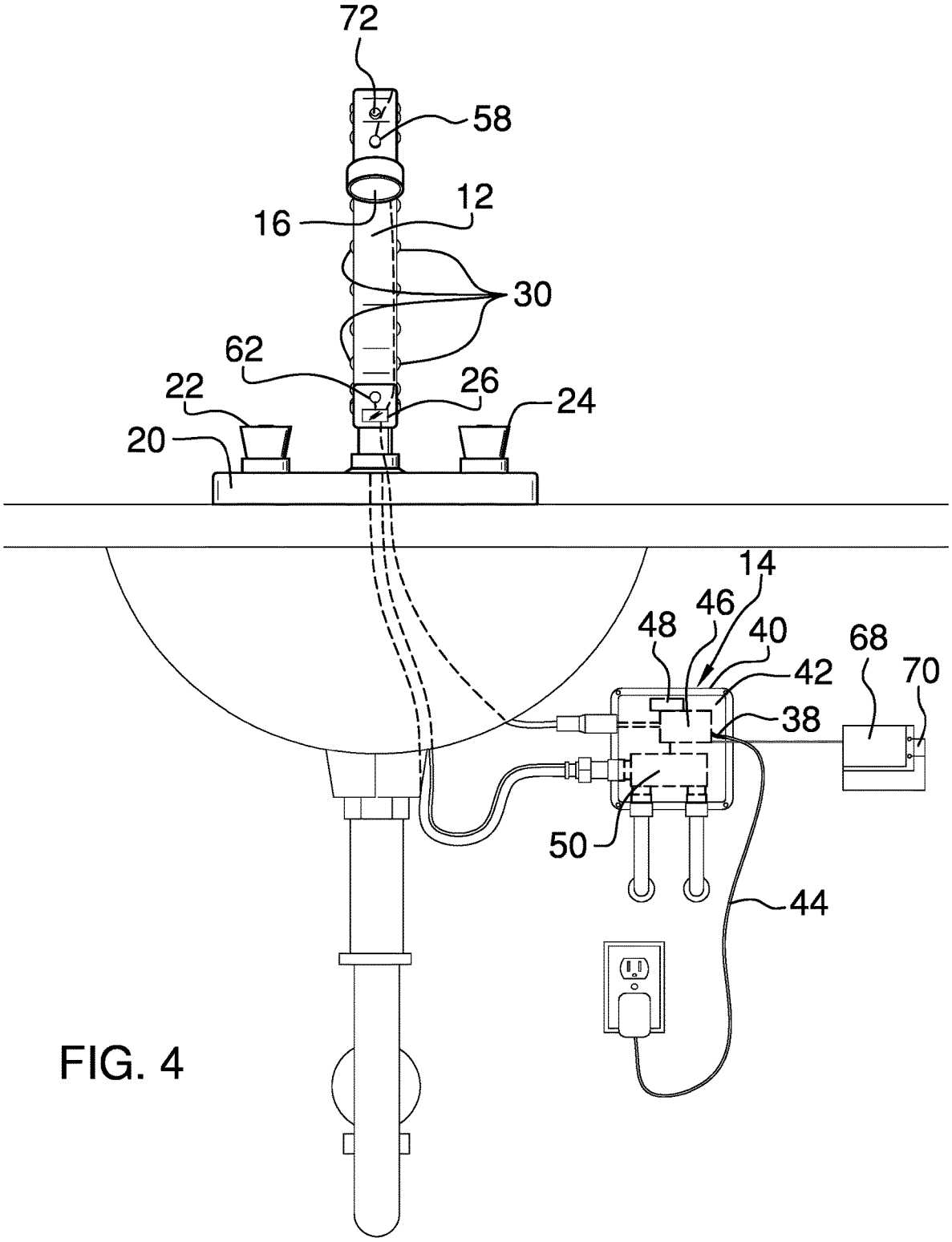
FIG. 4 is a front view of an embodiment of the disclosure.

The controller 14 comprises a housing 40 that defines an interior space 42. The housing 40 is coupled to an element proximate to an underside of the basin, such as a structural wall or a wall of a cabinet, as shown in FIG. 4. The power module 38 is positioned in the housing 40. The power module 38 comprises a power cord 44 that is configured to couple the controller 14 to a source of electrical current. The power module 38 also comprises a battery 68, which is rechargeable. A bracket 70 that is configured to be coupled to the element proximate to the underside of the basin is positioned to retain the battery 70. The battery 68 is positioned to provide backup power to the controller 14.

A microprocessor 46, a timer 48, and a valve 50 are coupled to the housing 40 and positioned in the interior space 42. The microprocessor 46 is operationally coupled to the power module 38, the sensor 26, and the plurality of lights 32. The timer 48 and the valve 50 are operationally coupled to the microprocessor 46. The timer 48 is positioned to signal the microprocessor 46 when a time that is set for the flow of water through the spout 12 expires. The valve 50 also is operationally coupled to a hot-water line and a cold-water line. The valve 50 is solenoid-actuated type.

The microprocessor 46 is positioned to receive a signal from the sensor 26 when the hand is positioned between the upper end 16 of the spout 12 and the basin. The microprocessor 46 is positioned to selectively actuate the valve 50 to fluidically couple the spout 12 to the hot-water line and the cold-water line. Concurrently, the microprocessor 46 is positioned to operationally couple the plurality of lights 32 to the power module 38 so that the lights 32 of each row 34 of lights 32 is configured to extinguish in order from a top 52 to a bottom 54 of the row 34. The sequential extinguishment of the lights 32 provides the indication to the user of the time remaining for the flow of the water through the spout 12. The controller 14 is positioned to decouple the spout 12 from the water source when the plurality of lights 32 is extinguished.

The microprocessor 46 also is operationally coupled to the hot-water knob 22 and the cold-water knob 24. The hot-water knob 22 and the cold-water knob 24 are configured to be rotated relative to the base 20 to signal respective flow rates of hot water and cold water to the microprocessor 46. The microprocessor 46 is positioned to selectively actuate the valve 50 to supply the respective flow rates of the hot water and the cold water to the spout 12.

A green bulb 56 is coupled to the spout 12 proximate to the upper end 16 of the spout 12, as shown in FIG. 1. The green bulb 56 is operationally coupled to the microprocessor 46. The microprocessor 46 is positioned to selectively couple the green bulb 56 to the power module 38 to indicate initiation of the flow of water from the spout 12. The green bulb 56 comprises a green-light emitting diode 58.

A red bulb 60 is coupled to the spout 12 proximate to the lower end 28 of the spout 12, as shown in FIG. 1. The red bulb 60 is operationally coupled to the microprocessor 46. The microprocessor 46 is positioned to selectively couple the red bulb 60 to the power module 38 to indicate termination of the flow of water from the spout 12. The red bulb 60 comprises a red-light emitting diode 62.

Figure 3:
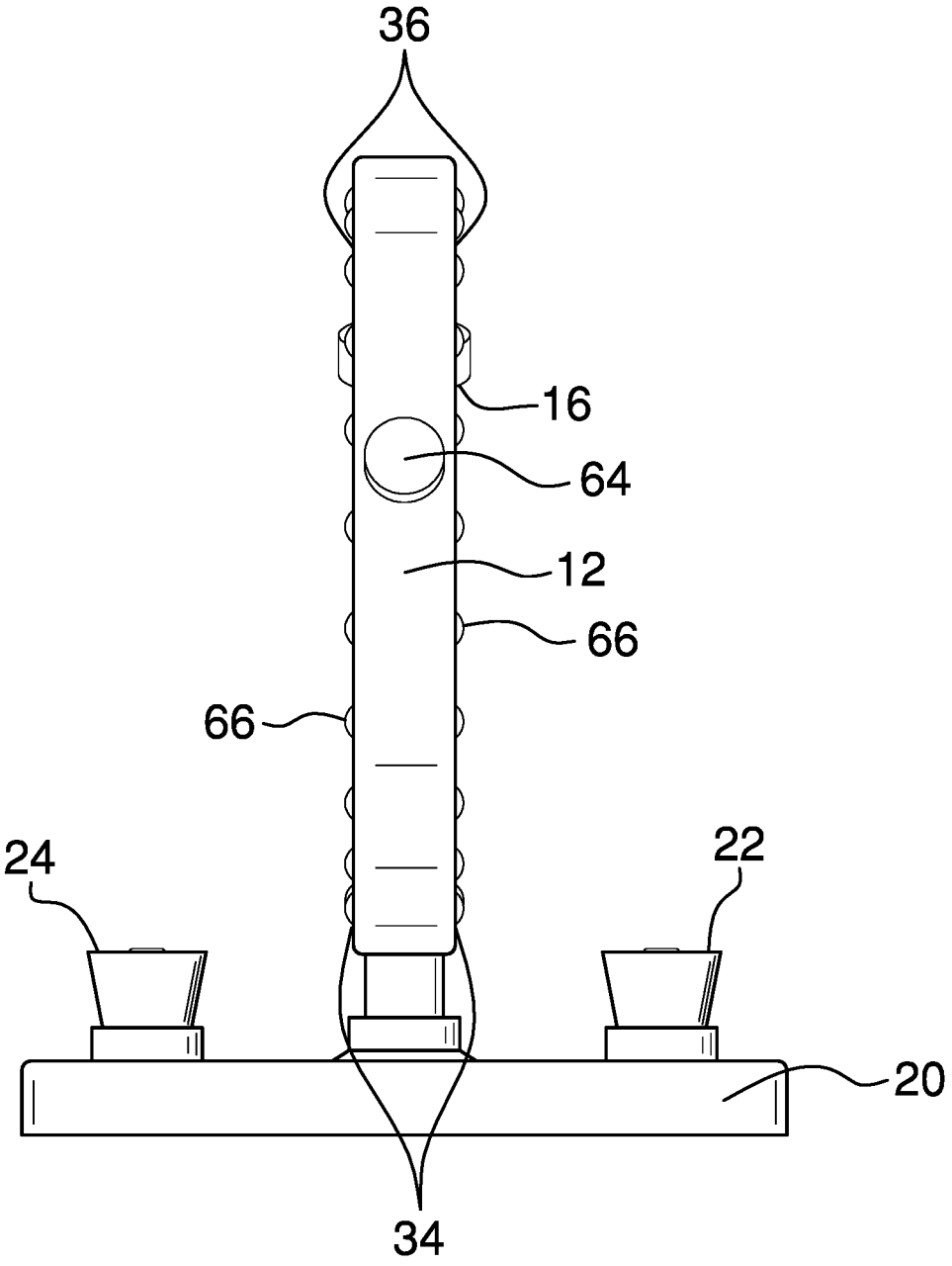
FIG. 3 is a back view of an embodiment of the disclosure.

A button 64 is coupled to the spout 12, as shown in FIG. 3. The button 64 is depressible. The button 64 is operationally coupled to the microprocessor 46. The button 64 is configured to be depressed a first time to signal the microprocessor 46 to operate in a first mode, wherein the barometer 30 and the sensor 26 are active. The button 64 is configured to be depressed a second time to signal the microprocessor 46 to operate in a second mode, wherein the barometer 30 and the sensor 26 are inactive.

An indicator bulb 72 is coupled to the spout 12 proximate to the upper end 16 of the spout 12, as shown in FIG. 1. The indicator bulb 72 is operationally coupled to the microprocessor 46. The microprocessor 46 is positioned to selectively and intermittently couple the indicator bulb 72 to the power module 38 to indicate a low charge level of the battery 68.

In use, the user positions his or her hands under the upper end 16 of the spout 12 and in front of the sensor 26. The sensor 26 sends the signal to the microprocessor 46, which actuates the valve 50 to start the flow of water. The microprocessor 46 also couples the plurality of lights 32 to the power module 38 so that the lights 32 of each row 34 of lights 32 extinguish in order from the top 52 to the bottom 54 of the row 34. The extinguishing of the lights 32 provides the indication to the user of the time remaining for the flow of the water through the spout 12. When the timer 48 indicates that the set time for the flow of water has expired, which is coincident with the extinguishment of the plurality of lights 32, the microprocessor 46 is positioned to actuate the valve 50 to decouple the spout 12 from the water source.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A timed touchless faucet assembly comprising:

a spout coupled to a surface proximate to a basin such that an upper end of the spout is positioned over the basin;

a sensor coupled to the spout, the sensor being proximity type wherein the sensor is configured for detecting a hand of a user positioned between the upper end of the spout and the basin;

a barometer coupled to the spout; and a controller comprising a power module, the controller being operationally coupled to the sensor, the barometer, the spout, and a water source wherein the controller is positioned for receiving a signal from the sensor when the hand is positioned between the upper end of the spout and the basin wherein the controller is configured for selectively fluidically coupling the spout to the water source concurrently with operationally coupling the barometer to the power module such that the barometer provides an indication to the user of a time remaining for a flow of water through the spout, the barometer comprising a plurality of lights coupled to the spout, the lights being positioned in a plurality of rows, each row extending a full length of the spout from proximate to the upper end to proximate to the lower end of the spout, the lights of each row of lights extinguishing in order from proximate to the upper end to proximate to the lower end of the spout such that the extinguishing of the lights provides the indication of time remaining for flow of water through the spout.

2. The assembly of claim 1, further including the spout being substantially C-shaped.

3. The assembly of claim 1, further including the spout having a cross-sectional profile, the cross-sectional profile being substantially rectangularly shaped.

4. The assembly of claim 1, further including the sensor being positioned on a lower end of the spout.

5. The assembly of claim 1, further including the plurality of rows comprising two rows positioned singly on opposing sides of the spout.

6. The assembly of claim 1, further including the controller comprising:

a housing defining an interior space, the housing being coupled to an element proximate to an underside of the basin, the power module being positioned in the housing;

a microprocessor coupled to the housing and positioned in the interior space, the microprocessor being operationally coupled to the power module, the sensor, and the plurality of lights;

a timer coupled to the housing and positioned in the interior space, the timer being operationally coupled to the microprocessor wherein the timer is positioned for signaling the microprocessor upon elapsing of a time set for the flow of water through the spout; and a valve coupled to the housing and positioned in the interior space, the valve being operationally coupled to the microprocessor, a hot-water line, and a cold-water line, the valve being solenoid-actuated type, wherein the microprocessor is positioned for receiving a signal from the sensor when the hand is positioned between the upper end of the spout and the basin wherein the microprocessor is positioned for selectively actuating the valve for fluidically coupling the spout to the hot-water line and the cold-water line concurrently with operationally coupling the plurality of lights to the power module such that the lights of each row of lights are configured for extinguishing in order from a top to a bottom of the row for providing the indication to the user of the time remaining for the flow of the water through the spout, wherein the controller is positioned for decoupling the spout from the water source when the plurality of lights is extinguished.

7. The assembly of claim 6, further including the power module comprising a power cord wherein the power cord is configured for coupling the controller to a source of electrical current.

8. The assembly of claim 7, further comprising:

the power module comprising a battery, the battery being rechargeable;

a bracket configured for coupling to the element proximate to the underside of the basin wherein the bracket is positioned to retain the battery such that the battery is positioned for providing backup power to the controller; and an indicator bulb coupled to the spout proximate to the upper end of the spout, the indicator bulb being operationally coupled to the microprocessor wherein the microprocessor is positioned for selectively intermittently coupling the indicator bulb to the power module for indicating a low charge level of the battery.

9. The assembly of claim 6, further comprising:

a base coupled to and positioned between the spout and the surface proximate to the basin;

a hot-water knob rotationally coupled to the base;

a cold-water knob rotationally coupled to the base; and the microprocessor being operationally coupled to the hot-water knob and the cold-water knob wherein the hot-water knob and the cold-water knob are configured for rotating relative to the base for signaling respective flow rates of hot water and cold water to the microprocessor positioning the microprocessor for selectively actuating the valve for supplying the respective flow rates of the hot water and the cold water to the spout.

10. The assembly of claim 6, further including a green bulb coupled to the spout proximate to the upper end of the spout, the green bulb being operationally coupled to the microprocessor wherein the microprocessor is positioned for selectively coupling the green bulb to the power module for indicating initiation of the flow of water from the spout.

11. The assembly of claim 10, further including the green bulb comprising a green-light emitting diode.

12. The assembly of claim 6, further including a red bulb coupled to the spout proximate to the lower end of the spout, the red bulb being operationally coupled to the microprocessor wherein the microprocessor is positioned for selectively coupling the red bulb to the power module for indicating termination of the flow of water from the spout.

13. The assembly of claim 12, further including the red bulb comprising a red-light emitting diode.

14. The assembly of claim 6, further including a button coupled to the spout, the button being depressible, the button being operationally coupled to the microprocessor wherein the button is configured for depressing a first time for signaling the microprocessor for operating in a first mode wherein the barometer and the sensor are active, wherein the button is configured for depressing a second time for signaling the microprocessor for operating in a second mode wherein the barometer and the sensor are inactive.

15. The assembly of claim 1, further including each light comprising a light emitting diode.

16. A timed touchless faucet assembly comprising:

a spout coupled to a surface proximate to a basin such that an upper end of the spout is positioned over the basin, the spout being substantially C-shaped, the spout having a cross-sectional profile, the cross-sectional profile being substantially rectangularly shaped;

a base coupled to and positioned between the spout and the surface proximate to the basin;

a hot-water knob rotationally coupled to the base;

a cold-water knob rotationally coupled to the base;

a sensor coupled to the spout, the sensor being proximity type wherein the sensor is configured for detecting a hand of a user positioned between the upper end of the spout and the basin, the sensor being positioned on a lower end of the spout;

a barometer coupled to the spout, the barometer comprising a plurality of lights coupled to the spout, each light comprising a light emitting diode, the lights being positioned in a plurality of rows, each row extending a full length of the spout from proximate to the upper end to proximate to the lower end of the spout, the lights of each row of lights extinguishing in order from proximate to the upper end to proximate to the lower end of the spout such that the extinguishing of the lights provides the indication of time remaining for flow of water through the spout, the plurality of rows comprising two rows positioned singly on opposing sides of the spout;

a controller comprising a power module, the controller being operationally coupled to the sensor, the barometer, the spout, and a water source wherein the controller is positioned for receiving a signal from the sensor when the hand is positioned between the upper end of the spout and the basin wherein the controller is configured for selectively fluidically coupling the spout to the water source concurrently with operationally coupling the barometer to the power module such that the barometer provides an indication to the user of a time remaining for a flow of water through the spout, the controller comprising:

a housing defining an interior space, the housing being coupled to an element proximate to an underside of the basin, the power module being positioned in the housing, the power module comprising a power cord wherein the power cord is configured for coupling the controller to a source of electrical current, the power module comprising a battery, the battery being rechargeable, a microprocessor coupled to the housing and positioned in the interior space, the microprocessor being operationally coupled to the power module, the sensor, and the plurality of lights, a timer coupled to the housing and positioned in the interior space, the timer being operationally coupled to the microprocessor wherein the timer is positioned for signaling the microprocessor upon elapsing of a time set for the flow of water through the spout, and a valve coupled to the housing and positioned in the interior space, the valve being operationally coupled to the microprocessor, a hot-water line, and a cold water line, the valve being solenoid-actuated type, wherein the microprocessor is positioned for receiving a signal from the sensor when the hand is positioned between the upper end of the spout and the basin wherein the microprocessor is positioned for selectively actuating the valve for fluidically coupling the spout to the hot-water line and the cold-water line concurrently with operationally coupling the plurality of lights to the power module such that the lights of each row of lights are configured for extinguishing in order from a top to a bottom of the row for providing the indication to the user of the time remaining for the flow of the water through the spout, wherein the controller is positioned for decoupling the spout from the water source when the plurality of lights is extinguished, the microprocessor being operationally coupled to the hot-water knob and the cold-water knob wherein the hot-water knob and the cold-water knob are configured for rotating relative to the base for signaling respective flow rates of hot water and cold water to the microprocessor positioning the microprocessor for selectively actuating the valve for supplying the respective flow rates of the hot water and the cold water to the spout;

a bracket configured for coupling to the element proximate to the underside of the basin wherein the bracket is positioned to retain the battery such that the battery is positioned for providing backup power to the controller;

an indicator bulb coupled to the spout proximate to the upper end of the spout, the indicator bulb being operationally coupled to the microprocessor wherein the microprocessor is positioned for selectively intermittently coupling the indicator bulb to the power module for indicating a low charge level of the battery;

a green bulb coupled to the spout proximate to the upper end of the spout, the green bulb being operationally coupled to the microprocessor wherein the microprocessor is positioned for selectively coupling the green bulb to the power module for indicating initiation of the flow of water from the spout, the green bulb comprising a green-light emitting diode;

a red bulb coupled to the spout proximate to the lower end of the spout, the red bulb being operationally coupled to the microprocessor wherein the microprocessor is positioned for selectively coupling the red bulb to the power module for indicating termination of the flow of water from the spout, the red bulb comprising a red-light emitting diode; and a button coupled to the spout, the button being depressible, the button being operationally coupled to the microprocessor wherein the button is configured for depressing a first time for signaling the microprocessor for operating in a first mode wherein the barometer and the sensor are active, wherein the button is configured for depressing a second time for signaling the microprocessor for operating in a second mode wherein the barometer and the sensor are inactive.

* * * * *